US007686705B1

(12) United States Patent
Foley

(10) Patent No.: US 7,686,705 B1
(45) Date of Patent: Mar. 30, 2010

(54) GOLF CLUB

(75) Inventor: Dennis Foley, Tuscon, AZ (US)

(73) Assignee: Golf Science Technology LLC, Oro Valley, CA (US)

( * ) Notice: Subject to any disclaimer, the term of this patent is extended or adjusted under 35 U.S.C. 154(b) by 0 days.

(21) Appl. No.: 11/852,982

(22) Filed: Sep. 10, 2007

(51) Int. Cl.
*A63B 53/12* (2006.01)
*A63B 53/10* (2006.01)

(52) U.S. Cl. ..... 473/297; 473/316

(58) Field of Classification Search ..... 473/316–323, 473/256, 297
See application file for complete search history.

(56) References Cited

U.S. PATENT DOCUMENTS 2,023,131 A * 12/1935 Gibson ..... 473/318
2,135,648 A * 11/1938 Stumpf ..... 473/233
2,462,955 A 3/1949 Glancey
2,608,409 A 8/1952 Pinkerton
2,950,115 A 8/1960 Hurdzan
3,341,203 A 9/1967 Brill
3,351,346 A 11/1967 Strahan
3,608,907 A 9/1971 Bouchard
3,680,870 A 8/1972 Burnett et al.
3,716,239 A 2/1973 Goudreau
4,037,668 A * 7/1977 Svejda ..... 172/371
4,045,034 A 8/1977 Thomas
4,444,396 A 4/1984 Wendt
4,588,191 A 5/1986 Stewart
4,602,788 A 7/1986 Wendt
4,809,975 A 3/1989 Lee
4,852,782 A * 8/1989 Wu et al. ..... 224/661
5,165,744 A * 11/1992 Vogrin ..... 294/19.2
5,178,394 A 1/1993 Tanampai
5,253,867 A * 10/1993 Gafner ..... 473/320
5,460,378 A 10/1995 Getts
5,494,279 A * 2/1996 Ahner ..... 473/386
5,527,039 A 6/1996 Levesque
5,573,468 A * 11/1996 Baumann ..... 473/312
5,711,718 A 1/1998 Mueller
5,769,734 A 6/1998 Qualey, Sr.
5,776,006 A 7/1998 Gruber (Continued)

OTHER PUBLICATIONS

Kelly, Bruce "Understanding Swingweight," www/golf.about.com/cs/componentscustonn/a/swingweight.htm, pp. 1-2, printed on Dec. 20, 2007.

(Continued)

*Primary Examiner*—Stephen L. Blau
(74) *Attorney, Agent, or Firm*—Venable LLP; Stefan J. Kirchanski

(57) ABSTRACT

An improved design for a golf club shaft and method increases stroke accuracy by significantly reducing stroke take-back distance. A ball traveling at a set initial velocity will travel a different distance on different parts of the course due to the friction of the grass on the ball which varies in response to height and moisture level. An inline weight management system that allows the moment of inertia of the club to be adjusted in a predictable manner. An increase in the moment of inertia translates into an increase in force which is in turn proportional to club velocity and resulting ball velocity. As green speed decreases, moment of inertia can be increased so that a stroke with a uniform take-back distance will deliver a shot that travels as far as the same stroke would deliver on a fast green.

4 Claims, 12 Drawing Sheets

U.S. PATENT DOCUMENTS

| | | | | |
|---|---|---|---|---|
| 5,807,183 | A * | 9/1998 | Benson | 473/206 |
| 5,993,325 | A | 11/1999 | Heyer | |
| 6,083,116 | A | 7/2000 | Loredo | |
| 6,120,385 | A | 9/2000 | Nemeckay | |
| 6,186,904 | B1 | 2/2001 | Bass | |
| 6,203,447 | B1 * | 3/2001 | Dillard | 473/316 |
| 6,231,453 | B1 | 5/2001 | Jebe | |
| 6,257,997 | B1 * | 7/2001 | Doble et al. | 473/516 |
| 6,343,999 | B1 * | 2/2002 | Murtland et al. | 473/289 |
| 6,358,157 | B1 | 3/2002 | Sorenson | |
| 6,413,168 | B1 * | 7/2002 | McKendry et al. | 473/239 |
| 6,475,098 | B1 | 11/2002 | Nemeckay | |
| 6,547,673 | B2 * | 4/2003 | Roark | 473/239 |
| 6,599,201 | B1 | 7/2003 | Grant | |
| 6,612,936 | B1 | 9/2003 | Matias | |
| 6,939,273 | B2 | 9/2005 | Zajac et al. | |
| 6,955,610 | B1 | 10/2005 | Czaaja et al. | |
| 7,048,640 | B2 | 5/2006 | Light | |
| 7,115,042 | B2 | 10/2006 | Gulan et al. | |
| 7,316,622 | B1 * | 1/2008 | Lucas | 473/239 |
| 2002/0091012 | A1 * | 7/2002 | Evans | 473/296 |
| 2002/0128085 | A1 | 9/2002 | Kallassy | |
| 2003/0224867 | A1 | 12/2003 | Ota | |
| 2004/0009826 | A1 | 1/2004 | Aisenberg | |
| 2004/0018885 | A1 | 1/2004 | Gulan et al. | |
| 2004/0023726 | A1 | 2/2004 | Ritson et al. | |
| 2004/0147333 | A1 | 7/2004 | Clark | |
| 2004/0259666 | A1 | 12/2004 | Bjugstad et al. | |
| 2005/0009620 | A1 * | 1/2005 | Hodgetts | 473/300 |
| 2005/0245324 | A1 | 11/2005 | Light | |
| 2006/0270487 | A1 | 11/2006 | Tu Teng | |
| 2007/0066418 | A1 | 3/2007 | Adams | |

OTHER PUBLICATIONS

Pedersen, Mike "Do You Understand Golf Club Swing Weight," www.ezinearticles.com/?Do-You-Understand-Golf-Club-Swing-Weight&id=46079, pp. 1-4, printed on Dec. 20, 2007.

* cited by examiner

GOLF CLUB

CROSS-REFERENCE TO PRIOR APPLICATIONS

Not Applicable

U.S. GOVERNMENT SUPPORT

Not Applicable

AREA OF THE ART

The present invention is in the area of golfing apparatus and more specifically a system for improving club function.

BACKGROUND

Golf is a popular game, sport and avocation that requires a great deal of skill to play with precision. In fact, the game can be remarkably difficult demanding a considerable degree of athletic skill. Over the years a large number of training systems and specialized golfing implements have been developed to aid both the novice and the more experienced players. As might be expected, club design has been an area of significant innovation.

Much effort has gone into design of the club head since this is the part of the club that strikes the ball and controls the transfer of energy as well as the aiming of the ball. Apart from efforts to make the club shaft lighter and stronger, not as much effort has gone into shaft design.

However, there has long been a recognition that club function can be altered according to the distribution of weight along the shaft. A number of prior art devices have included ring shaped weights surrounding and attached to the gold club shaft in an effort to alter the weight distribution of the club. However, such attached weights are not completely in line with the shaft and the protruding weights may have undesired aerodynamic effects. In addition, while there has been an understanding that altering the weight distribution alters the way the club behaves, there has generally not been a method for effectively employing such alterations in weight distribution.

SUMMARY OF THE INVENTION

An improved design for a golf club shaft is described along with a method of using clubs including the improved shaft to increase stroke accuracy by significantly reducing stroke take-back distance. While the improved shaft is particularly suited to use on golf putters, it is useful with drivers and other club types as well. Accurate golf strokes are particularly difficult because of the need to deliver shots where there is a tremendous variation of distance as well as variation in surface speed characteristics. Surface speed characteristics refer to the phenomenon where a ball traveling at a set initial velocity will travel a different distance on different parts of the course. This is due to the friction of the grass on the ball. This varies on different parts of the course (e.g., the fairway versus the green) as well as the local characteristics of the grass (height, moisture level, etc.). As explained below surface speed characteristics are most commonly measured and expressed in terms of "green speed" but a similar measurement can also be made on other regions on a golf course.

When making long shots on a golf course, differences in desired shot distance can be at least partly controlled by choice of club. A uniform controlled stroke is used and produces the desired result in conjunction with the proper club. In putting the surface speed characteristics (green speed) are critical, and a selection of different putters for a variety of green speeds is generally not available. For a fast green a ball will travel too far unless the take-back distance and/or the force of the swing is not reduced. For attaining the same distance on a slow green more force and/or take-back distance is required. Increased take-back distance results in decrease accuracy particularly with amateur golfers whose hand coordination is insufficient to always maintain optimum club head orientation.

The present invention provides an inline weight management system that allows the moment of inertia of the club to be adjusted in a predictable manner. The system consists of one or more longitudinally slots within the shaft of the club. The slots are sized to accept one or more weights that are then fixed with bolts or other fasteners within the shaft. The moment of inertia is maximally altered by adding weight near the head of the club. The same weight added farther from the head has a smaller effect. An increase in the moment of inertia translates into an increase in force which is in turn proportional to club velocity. Increasing club velocity results in higher ball velocity so that the ball will travel a greater distance on a surface having a particular green speed. Thus, as green speed decreases moment of inertia can be increased so that a stroke with a uniform take-back distance will deliver a shot that travels as far as the same stroke would deliver on a fast green.

A method for use with the weight management system allows a golfer to develop a uniform and consistent stroke with an optimal (i.e., short) and consistent take-back distance. Once such a stroke is developed, this same stroke can be applied regardless of surface speed characteristics (green speed) by using the weight management system to increase ball velocity to precisely compensate for decreases in green speed. Because the weight added for altering the moment of inertia is completely inline with the shaft of the club, it has no effect on the aim of the stroke.

The invention can best be understood by reference to the figures and the following Detailed Description.

DETAILED DESCRIPTION OF THE INVENTION

Figure 1:
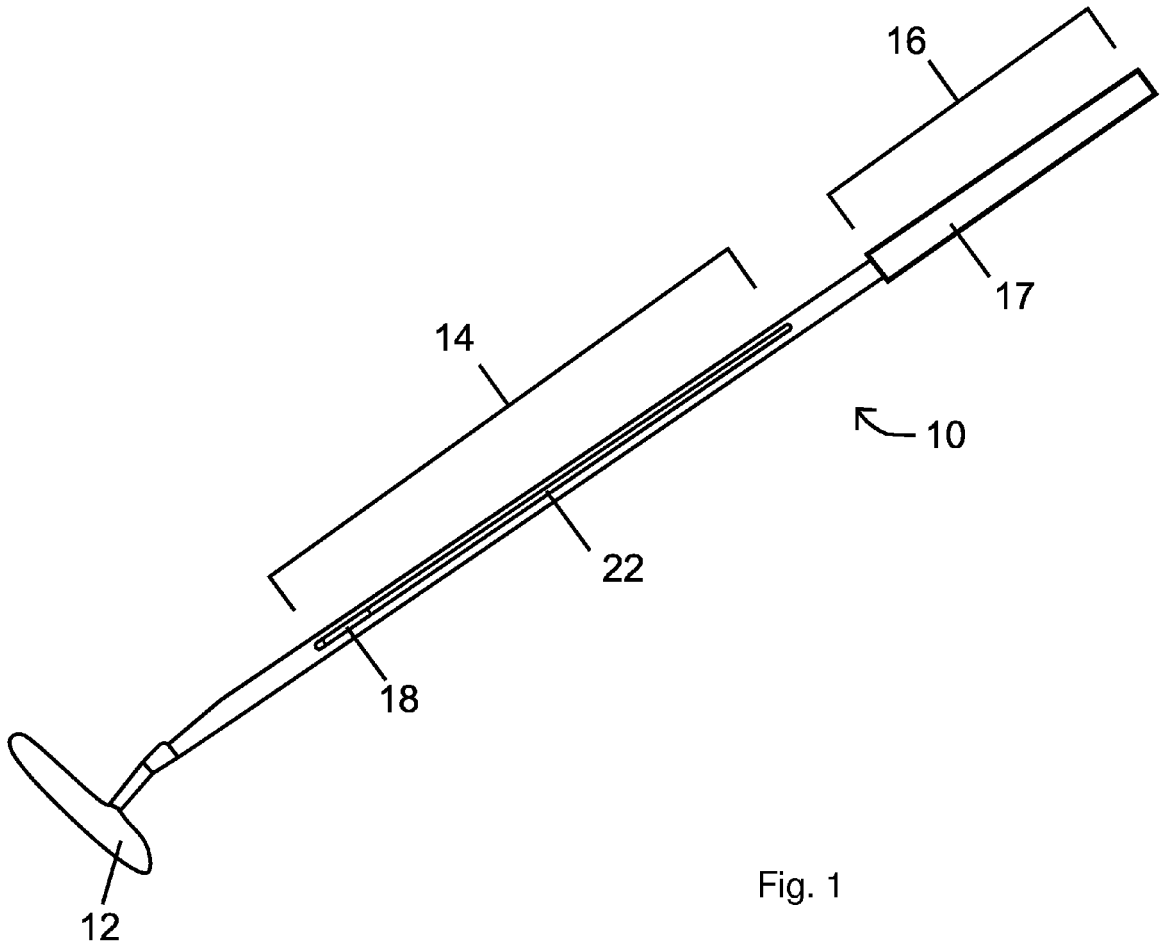
FIG. 1 shows a diagram of the inventive club illustrating a side view of the shaft.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a weight adjustment system for improved golf club—particularly putter club—function.

Golf can be a frustrating as well as exhilarating sport. The general idea of striking a small ball with a thin club so that the ball travels a great distance to roll or fall into a target which is a small hole in a lawn suggests that the sport is far from easy. While the game inherently uses a variety of differently configured clubs for different purposes (e.g., driving the ball down the fairway or lofting the ball from a sand trap), recently the sport has seen an increase in specialized club designs—each intended to improve some particular aspect of a player's performance. Most frequently the head of the club is redesigned to improved aim, distance or some other factor. In the past there have been a variety of systems and add-ons intended to influence and control a player's stroke. There have even been a number of "weight management systems" that generally consist of moveable weights surrounding the shaft. However, such systems modified the aerodynamic properties (i.e., the aim of the stroke) of the shaft and did not include a method to rationally instruct a player how to utilize the system.

The present invention includes a system for modifying weight distribution on a golf shaft so as to improve the overall accuracy of a stroke. Most people understand the importance of stroke aim particularly in putting; however, many fail to understand that the most important variable in a stroke is actually stroke speed or head velocity (that is the initial velocity of a properly struck ball) which translates to distance of ball travel. The big question is what amount of force must be applied to the club to obtain the correct head velocity and corresponding optimum ball speed? Without optimal speed the ball will never reach the target (that is, distance will be insufficient). Not only must the ball have sufficient speed to reach the target, the ball also must travel at a specific speed to allow the ball to track correctly the contours of the green—that is "break" correctly. In that way the ball will reach the target hole by following the desired contour. Thus, speed affects not only the distance the ball travels but also the effective aim of the stroke.

A golf club—particularly a putter—conforms to the physical laws governing the action of pendulums. A specific force exerted by the user through the grip of the club translates into a certain club head speed which translates into ball speed when the head strikes the ball. To achieve a particular club head speed the user must swing the putter head back and forth on a given arc much like the pendulum of a grandfather's clock with the pivot point of the pendulum being the shoulder joint of the user. The distance the club head is taken back (take-back distance) at the initiation of a stroke (to achieve proper head velocity) matches the distance the club swings forward after striking the ball. As the pendulum (club) swings downward the user applies force to accelerate the club to the desired velocity. Obviously, the longer the downward swing, the more time to apply force and the higher the final velocity. When the club head strikes the ball at the lowest point in the swing, momentum or energy is transferred to the ball and the ball is accelerated to essentially the same velocity as the moving club. Thus, the take-back distance and the amount of force applied directly affect the velocity of the ball. If the applied force is consistent from stroke to stroke, the take-back distance directly controls the velocity of the ball. While it is possible to vary both the force and the take-back distance to achieve optimal putts, many players do not have adequate ability to simultaneously handle both variables. For this reason the present system attempts to have the player maintain a consistent expenditure of force and control the velocity via take-back.

Putting provides a good example; As the distance to the target (e.g., the hole) increases, the distance the putter must be taken back increases so that a greater initial velocity can be imparted to the ball. As the take back distance increases, so does the potential for error because with a greater take back distance there is a greater tendency for the putter head to twist and turn off dead center during the swing. This is primarily a coordination problem. In using the arms to swing a club in a pendulum configuration, a variety of different muscles must be sequentially energized. At more extreme take-back distances it becomes more and more difficult to maintain consistent hand position as the various muscles contract. This causes a change in position so that the shaft is twisted either clockwise or counterclockwise, thereby moving the face of the club head away from a perpendicular address of the ball. If the putter head is not perpendicular (i.e., on dead center) when it strikes the ball, the aim will be compromised and optimum energy transfer to the ball will not occur. That is, the ball will be driven in the wrong direction and will not attain the desired speed. This twisting and turning is referred to as a push or a pull in golf nomenclature. A push occurs when the club head strikes the ball with the heal section of the head ahead of the toe section. This non-perpendicular strike causes the ball to move to the right of the intended path to the target. A pull occurs when the club head strikes the ball with the toe section ahead of the heal section. A pull causes the ball to move to the left of the intended path to the target.

Optimally, one should be able to produce a range of head velocities (to correspond to a variety of distances to the target as well as a variety of green conditions) at the same optimum take-back distance. By optimum take-back distance is meant a distance sufficiently small to minimize any tendency for the putter head to twist or turn off dead center. The weight management system of the current invention makes this possible by allowing the user to alter the weight distribution of the club without altering its aerodynamic properties. A putter, like a clock pendulum, has a concentration of weight at its distal end (the head of the club or the bob of the pendulum). If the distribution of weight along the length of the club is changed, the head velocity for a given applied force changes. This allows one to reliably control head velocity FIG. 1 shows an overall diagram of the inventive club. The device 10 consists of a putter head 12, a split or "dual rail" central shaft 14 and a grip portion 16. In the illustrated club the central shaft portion 14 bears a 3/16" thick slot (0.476 cm) machined from aluminum and the grip portion 16 consists of a tube portion (chromed steel or the like) attached to the central shaft portion and covered, at least in part, by a rubberized grip 17 as is well known in the art of golf clubs. The putter head 12 is a standard putter head which heads are available in a number of different designs. The present invention is directed to the central shaft portion 14 which can be used with any of the currently available putter heads. A suitable putter head is press fitted or otherwise attached to the dual rail central shaft portion 14.

Figure 2:
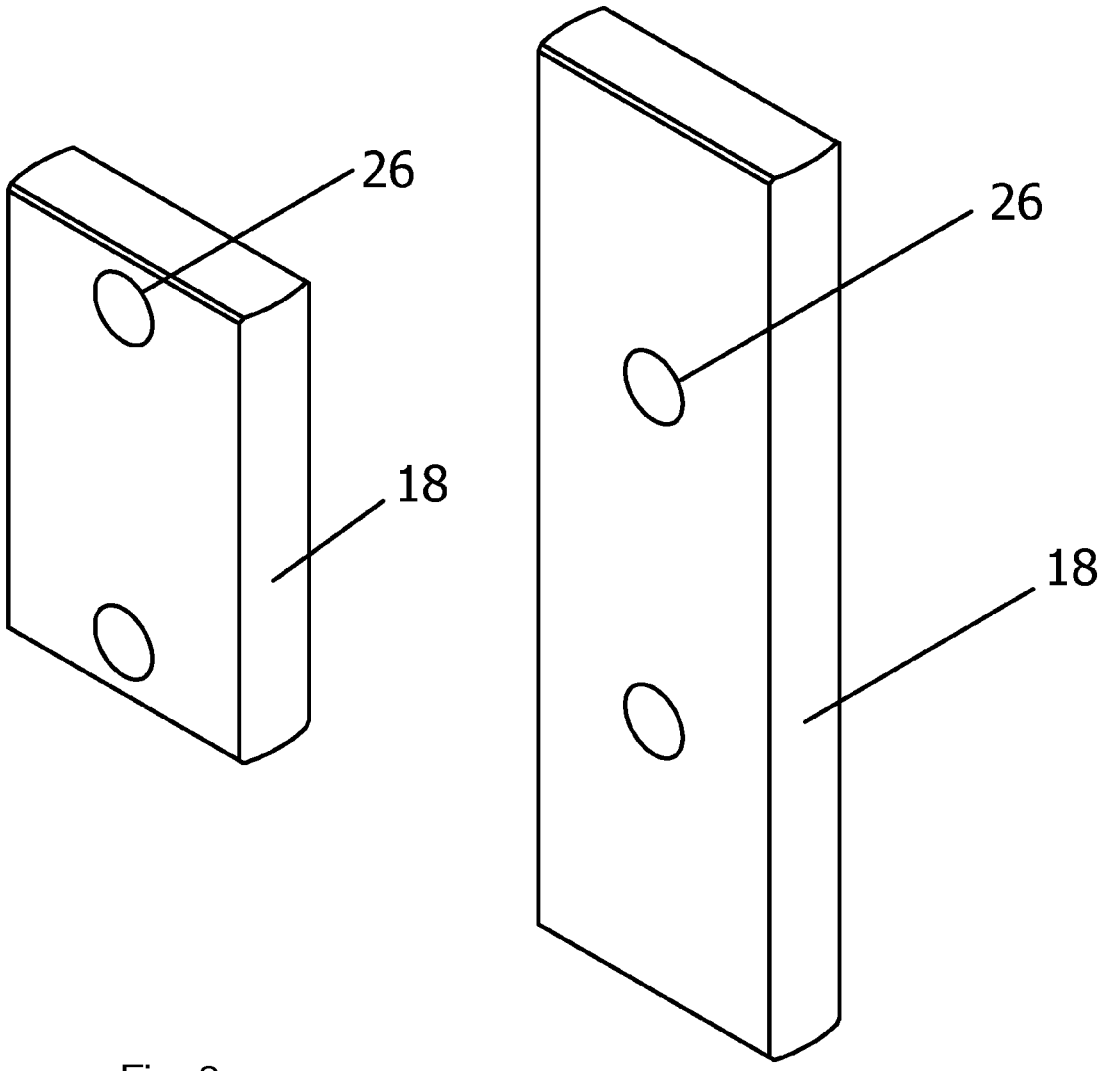
FIG. 2 is view of weights used in the device.
Figure 3:
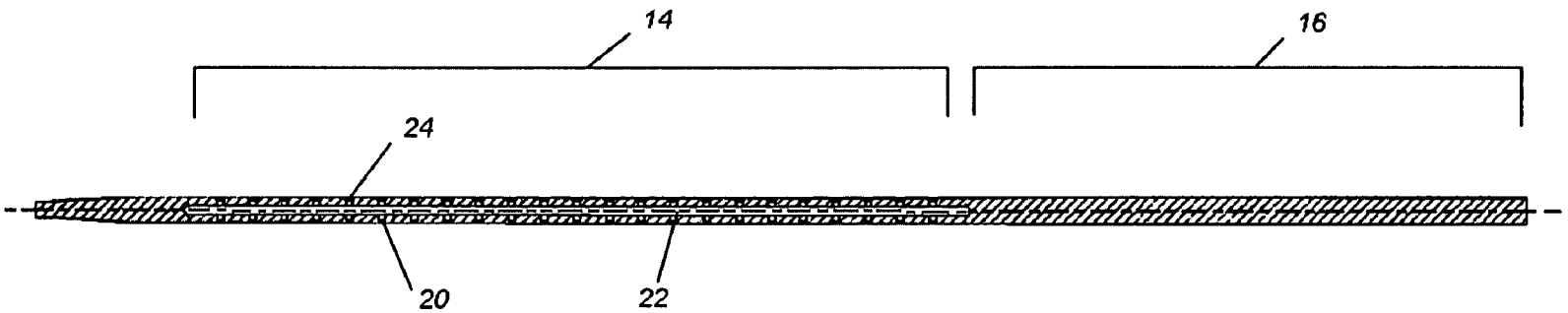
FIG. 3 is cross-section of the split rail shaft showing holes to accept bolts
Figure 4:
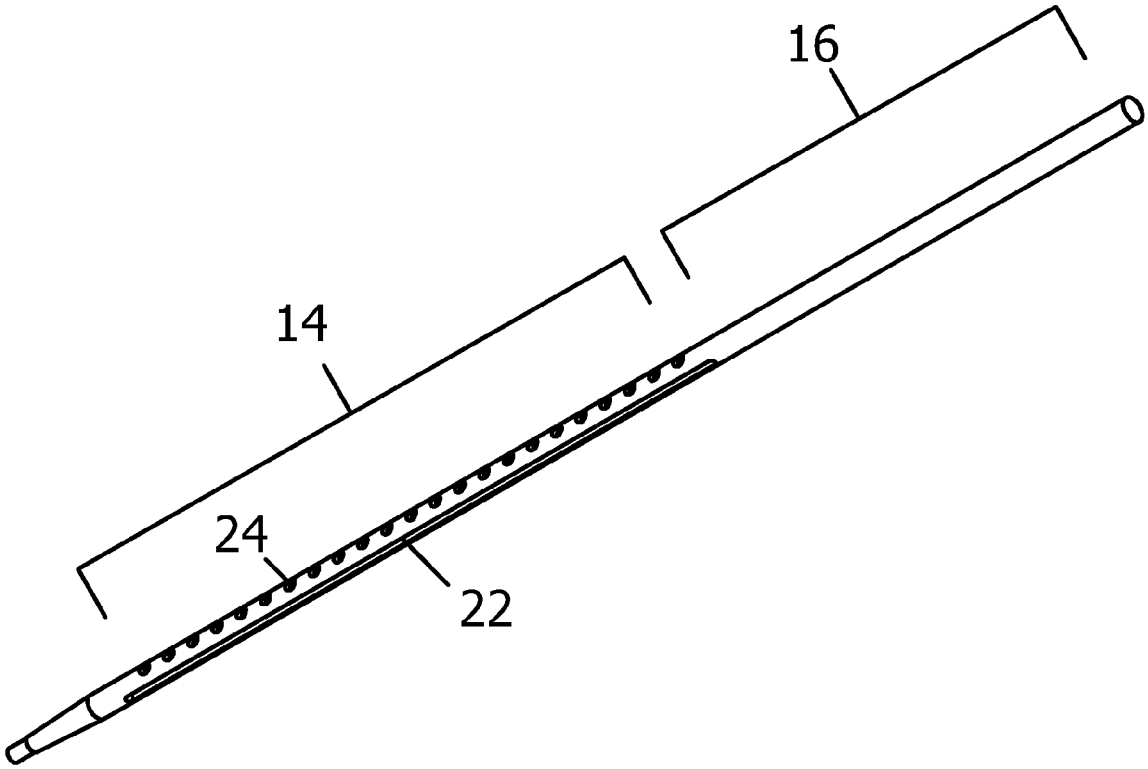
FIG. 4 is a perspective of the split rail portion of the shaft.

In the illustrated example the split rail 14 is machined from an "aircraft" grade alloy selected for its tensile strength and rigidity. As will be mentioned below, it is also possible to mold the structure from composite materials or even assemble it from separate rail components. The device of FIG. 1 has a 12" (30.5 cm) long slot 22 that is about 3/16" (4.76 mm) in thickness. The purpose of the inline slot is to accept one or more of a series of weights. As shown in FIG. 2 the weights 18 are rectangular in shape and are sized to fit entirely within the slot 22 so that the edge of the weight 18 is essentially flush with the outer surface of the shaft 14. Each weight bears two non-threaded holes 26 so that bolts inserted through spaced apart (0.75"—or about 1.0 cm) countersunk holes 24 in the split rail portion 14 can pass through the non-threaded holes 26 and engage the threaded holes 20 within the lower of the two rails (that is to say, the end portion of each of the countersunk holes 24 is threaded) and fix the weight 18 in position. See FIGS. 3 and 4. The spacing of the countersunk holes 24 is a design choice and other spacings are applicable; other mechanical means for fastening the weights in place are also applicable such as détentes, pins and clips. As will be discussed below a simplified version of the slot 22 is also possible. The slots illustrated pass all the way through the shaft. It will be appreciated that a similar effect can be achieved where the slot does not pass all the way through the shaft—that is, the slot is more of a groove.

The weights are preferably machined from a relatively dense metal and are available with a number of different mass values. Currently weights of 0.5 oz (14.17 g), 1.0 oz (28.35 g), 2 oz (56.7 g), 3 oz (85.05 g) and 4 oz (113.4 g) are used although weights with intermediate values and values above or below this range are useable in some instances. Any dense metal is useable. Stainless steel and copper are currently preferred because of their high density, relatively low cost and lack of toxicity. One of skill in the art will appreciate that other dense metals such as tungsten or lead will also serve this purpose. It will also be appreciated that the desired inline nature of the inserted weights limits the size of the weights. To achieve weights appreciably above 4 oz it is generally necessary to use a material with a density higher than copper or stainless steel. A composition weight made from several metals or alloys thereof can also be used. In fact, composites of organic polymer loaded with a high percentage of dense metal powder are also useable. For cosmetic purposes it is preferable to chrome plate the weights although other finishes may be used.

It will be apparent that the length of the slot 22 is related to the length of the club's shaft as well as the skill level of the player. A low handicap (high skill) player has the ability to more consistently control hand movement. Therefore, such a player requires only weight control towards the putter head—for such players the shorter slots may be preferred. Players with a higher handicap lack such skill and require control over a greater range of club velocities—for such players relatively longer slots are favored. Currently, the aluminum device is manufactured with four different slot lengths ranging from about 12" (30.48 cm) to about 18" (45.72 cm) with a step size of 2" (5 cm) between each slot size. Clearly, the slots can diverge somewhat from this size range although the inventor believes that this range encompasses the most useable slot lengths. Current putters generally come with 32" (81.28 cm), 33" (83.82 cm) or 34" (86.36 cm) shaft lengths. This is achieved in the current invention by varying the length of the grip portion 16 added to the split rail 14 portion of the shaft. The putter head 12 adds length to the completed club; for example one popular putter is 54" (137 cm) in length (head to grip). Modern golf clubs are also constructed from composite materials such as plastics reinforced with carbon fiber. In that case of a carbon fiber shaft the entire grip 16 and split shaft portion 14 can be molded and/or milled as a single piece.

To understand how to best use the weight distribution system of the present invention, it is useful to examine the physics underlying the behavior of the inventive club. In the case of putter shaft movement, the user's arms and hands are locked into position and pivot from a pivot point at the shoulders. As discussed above this results in a pendulum where the arms and the shaft form the suspending element of the pendulum and where the head of the club serves as the bob of the pendulum. With this configuration in mind it is possible to make assumptions that allow the use of relatively simple physics formulae to appreciate the function of the weight control system. These assumptions include: 1) the shoulder is the pivot point (o) and the arms and hands operate as a lever connected to that point; 2) the swing from the pivot point (o) is of a constant angular velocity; and 3) the arms and hands have no mass. These assumptions allow one to isolate just the effect of the weights and their position on the shaft in terms of head speed. Further the assumptions can be justified because the position of the hands and arms relative to the club remains constant regardless of weight position and thus do not effect changes in head speed.

When the moving club strikes the ball momentum (energy) is transferred to the ball accelerating it to essentially the speed of the moving head. Therefore, it is assumed that head velocity and ball speed are essentially equivalent. To isolate the energy involved so as to understand the relationship between moveable weight position and head velocity one can consider the total kinetic energy or moment of inertia ($I_o$) of the system according to Formula 1 where "$m_s$" is the mass of the shaft; "$m_h$" is the mass of the head; and "$m_w$" is the mass of the moveable weight. Similarly, "$l_s$" is the distance from the pivot point o to the center of gravity of the shaft; "$l_h$" is the distance from the pivot point o to the center of gravity of the head; and "$l_w$" is the distance from the pivot point o to the center of gravity of the moveable weights.

$$I_o=(m_s l_s^2+m_h l_h^2+m_w l_w^2) \quad \text{Formula 1}$$

From Formula 1 one is able to derive Formula 2 which yields the head velocity $V_m$ which is assumed to be the initial ball velocity as well. The initial angular velocity (i.e., before striking the ball) is $\omega_i$ while the final angular velocity (i.e., after striking the ball) is $\omega_f$ and the mass of the ball is $m_b$.

$$V_m=\sqrt{(m_s l_s^2+m_h l_h^2+m_w l_w^2)(\omega_i^2-\omega_f^2)/m_b} \quad \text{Formula 2}$$

The goal is to determine differences in force applied to the ball as the weight position changes. Therefore, in solving for $V_m$ one can simplify the calculation by assuming that the difference between the initial and final angular velocity. It is also safe to assume that the difference in angular velocity before and after striking a ball is the same for both a weighted and unweighted shaft. For the purpose of the following simulations, $(\omega_i^2-\omega_f^2)$ was set to 1 rad./s. The mass of the ball (a constant) is included to allow a ready check on the magnitude of the velocity The impulse-momentum theorem (Formula 3) can be used to calculate the average force ($F_{av}$) applied to the ball. $V_b$, the initial velocity of the ball is approximately equal to $V_m$, the velocity of the head when it strikes the ball. The duration of contact between the head and the ball ($\Delta t$) is assumed to be 10 ms.

$$F_{av}=\frac{m_b V_b}{\Delta t} \quad \text{Formula 3}$$

Figure 5:
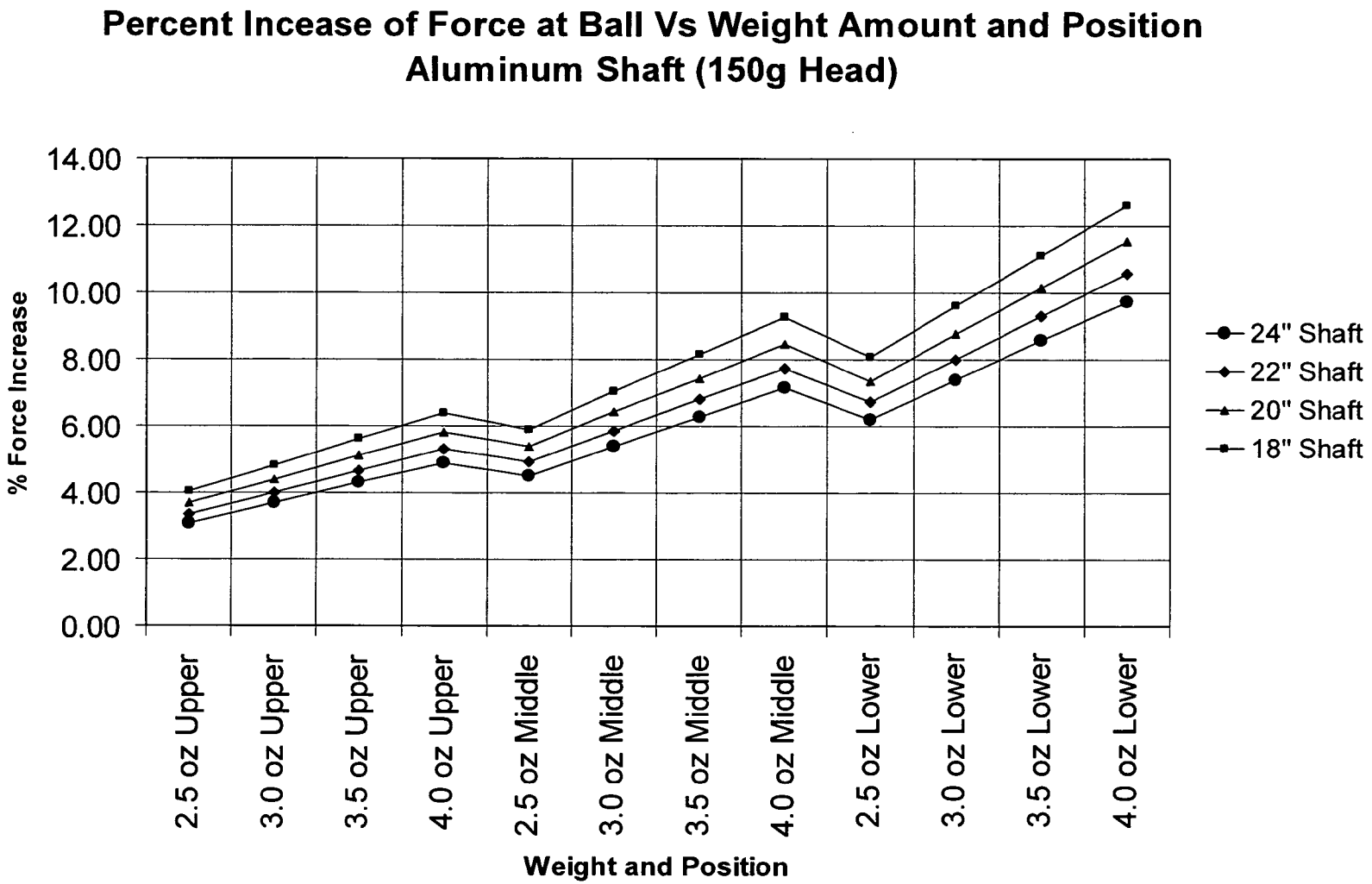
FIG. 5 is a chart showing the increase of force on the ball at different weight positions and shaft lengths of an aluminum shaft club with a 150 g head on the club.
Figure 6:
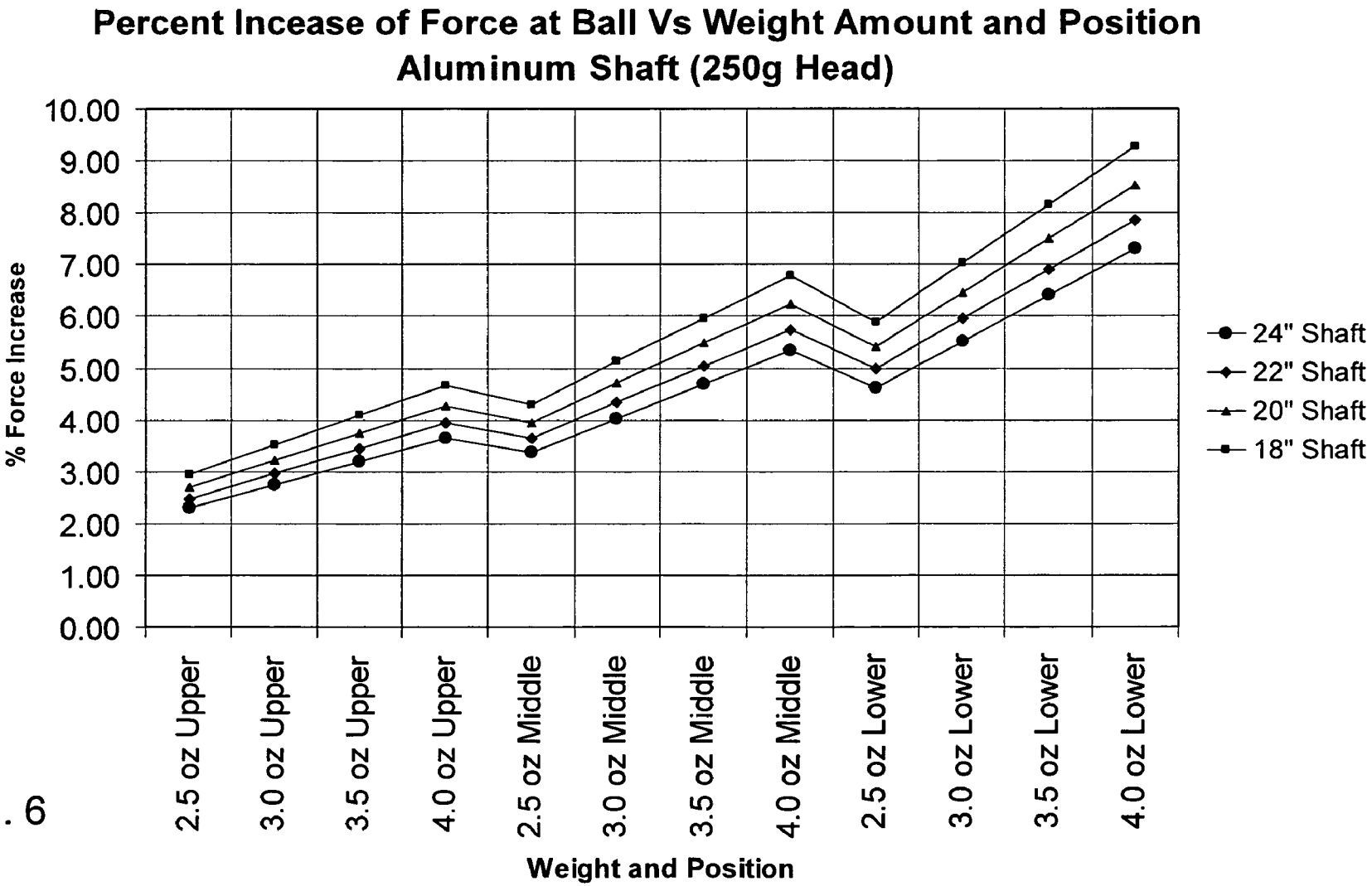
FIG. 6 is a chart showing the increase of force on the ball at different weight positions and shaft lengths of an aluminum shaft club with a 250 g head on the club.
Figure 7:
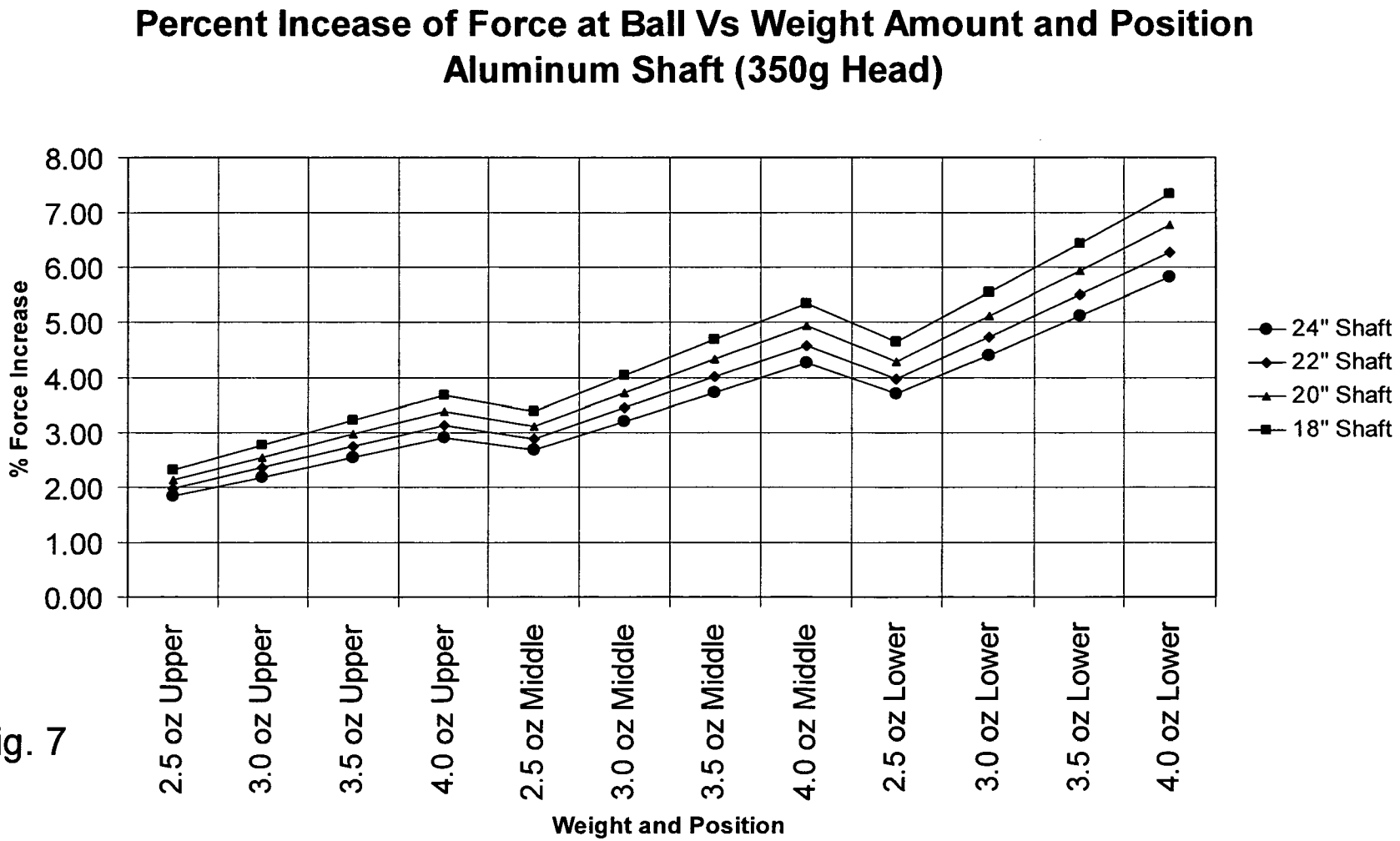
FIG. 7 is a chart showing the increase of force on the ball at different weight positions and shaft lengths of an aluminum shaft club with a 350 g head on the club.
Figure 8:
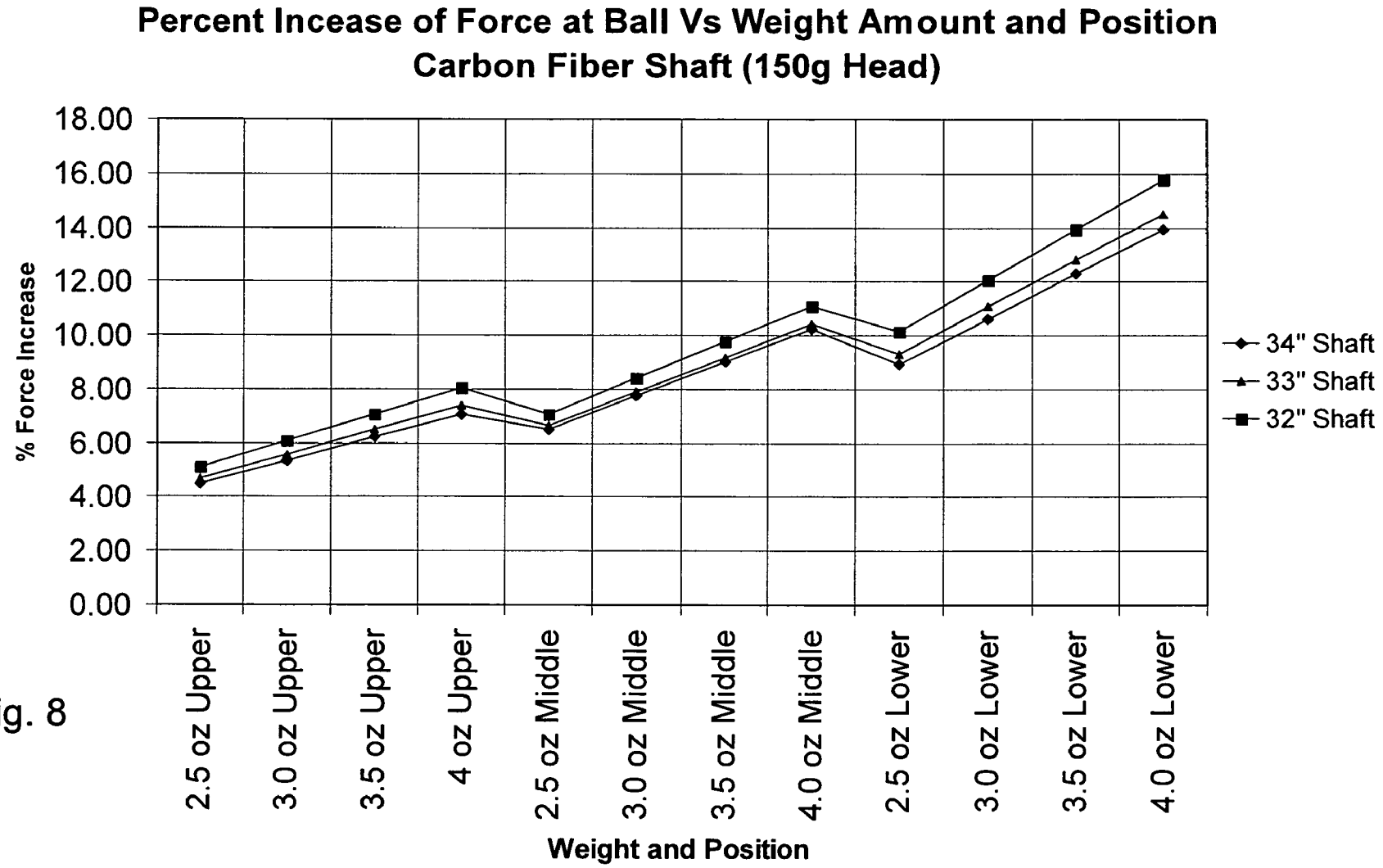
FIG. 8 is a chart showing the increase of force on the ball at different weight positions and carbon fiber shaft lengths with a 150 g head on the club.
Figure 9:
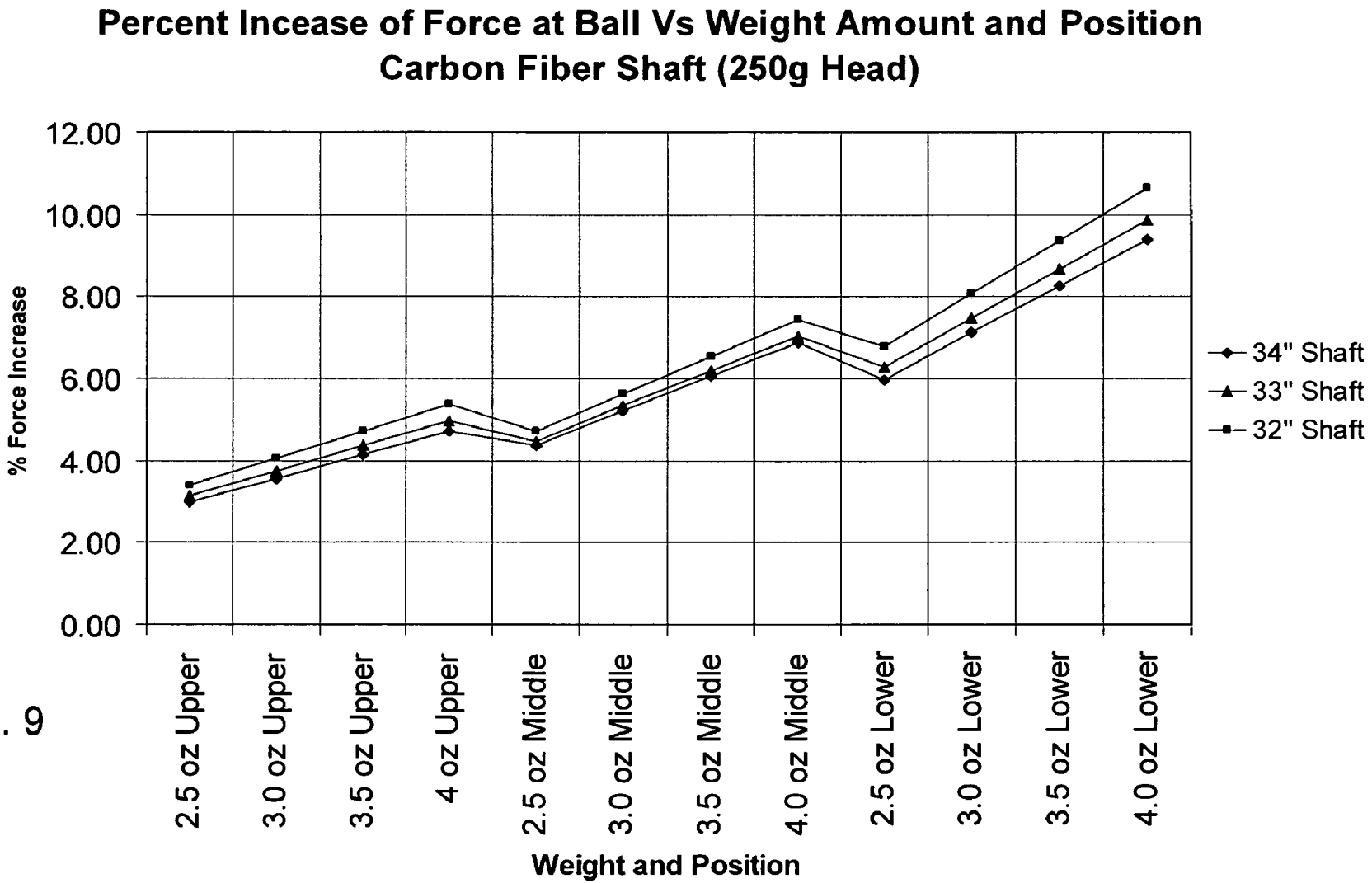
FIG. 9 is a chart showing the increase of force on the ball at different weight positions and carbon fiber shaft lengths with a 250 g head on the club.
Figure 10:
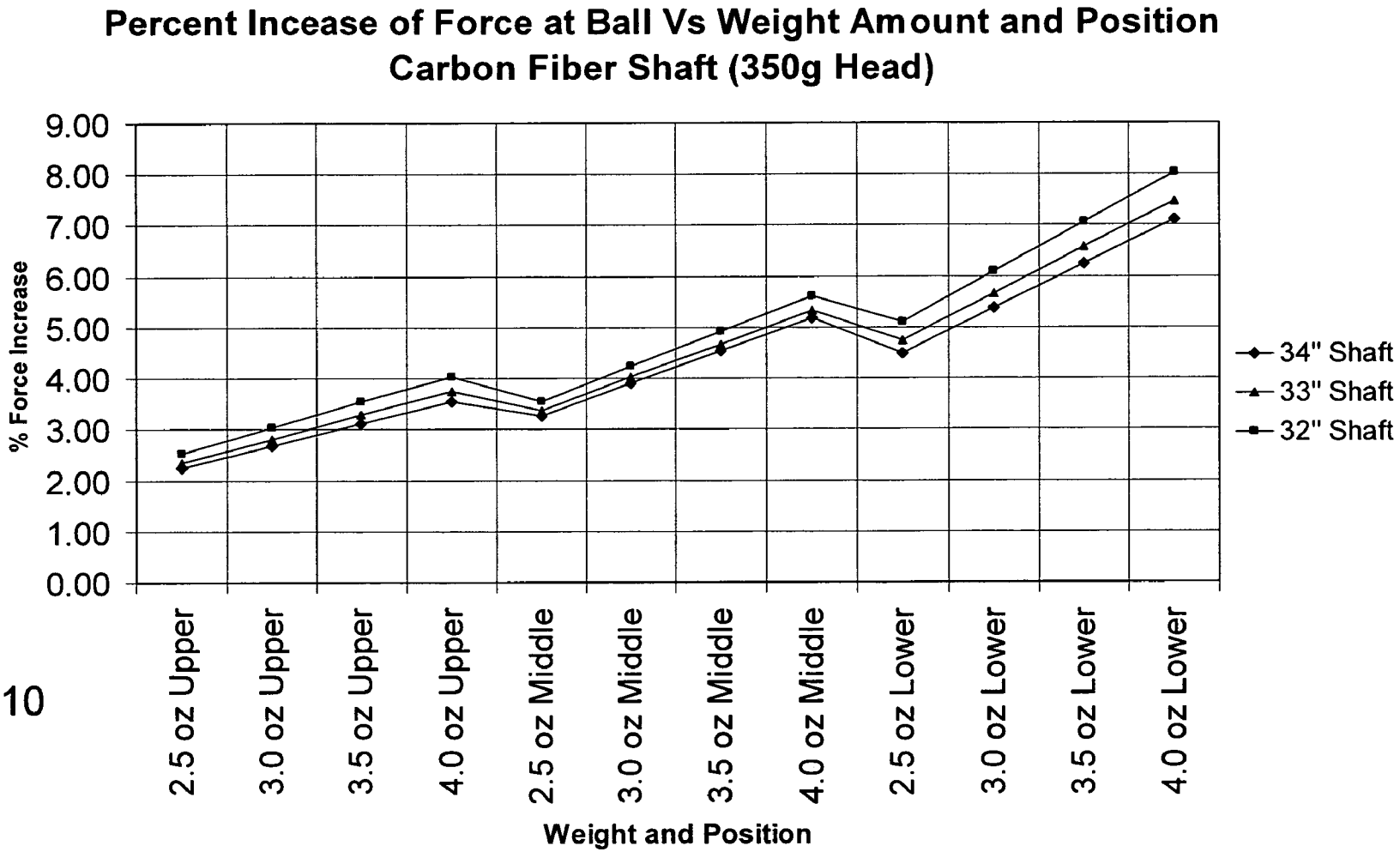
FIG. 10 is a chart showing the increase of force on the ball at different weight positions and carbon fiber shaft lengths with a 350 g head on the club.

The above formulae were used to calculate force parameters for a variety of different configurations of the inventive club which results are displayed in the figures. Table 1 shows the configurations for the aluminum shaft clubs (FIGS. 5-7) While Table 2 shows the configurations for the carbon fiber shaft clubs (FIGS. 8-10).

TABLE 1

| Aluminum Shaft (measurements in inches (cm)) | | | | | | | |
|---|---|---|---|---|---|---|---|
| Shaft Length | Slot Length | Slot Bottom to Head | Slot Top To Head | Slot Bottom to Grip End | Slot Top To Grip End | Slot Bottom to Pivot | Slot Top To Pivot |
| 24 (60.96) | 18 | 3.6 | 21.6 | 31.5 | 13.5 | 49.5 | 31.5 |
| | (45.72) | (9.14) | (54.86) | (80.01) | (34.29) | (125.73) | (80.01) |
| 22 (55.88) | 15.88 | 3.72 | 19.6 | 29.38 | 13.5 | 47.38 | 31.5 |
| | (40.33) | (9.32) | (49.78) | (74.63) | (34.29) | (120.35 | (80.01) |
| 20 (50.80) | 13.5 | 3.85 | 17.35 | 27 | 13.5 | 45 | 31.5 |
| | (34.29) | (9.78) | (44.07) | (68.58) | (34.29) | (144.30 | (80.01) |
| 18 (45.72) | 12 | 3.6 | 15.6 | 25.5 | 13.5 | 43.5 | 31.5 |
| | (30.48) | (9.14) | (39.62 | (64.77) | (34.29) | (110.49) | (80.01) |

TABLE 2

| Carbon Fiber Shaft (measurements in inches (cm)) | | | | | | | |
|---|---|---|---|---|---|---|---|
| Shaft Length | Slot Length | Slot Bottom to Head | Slot Top To Head | Slot Bottom to Grip End | Slot Top To Grip End | Slot Bottom to Pivot | Slot Top To Pivot |
| 34 (86.36) | 18 | 3.6 | 21.6 | 31 | 13 | 49 | 31 |
| | (45.72) | (9.14) | (54.86) | (78.74) | (33.02) | (124.46) | (78.74) |
| 33 (83.82) | 17 | 3.85 | 20.85 | 30 | 13 | 48 | 31 |
| | (43.18) | (9.78) | (52.96) | (76.20) | (33.02) | (121.92) | (78.74) |
| 32 (81.28) | 16 | 3.72 | 19.72 | 29 | 13 | 47 | 31 |
| | (40.64) | (9.32) | (50.09) | (73.66) | (33.02) | (119.38) | (78.74) |

The aluminum shaft clubs have slot lengths between 12" and 18" while the carbon fiber shaft clubs have a more restricted slot range of 16" to 18." Note that the distance from the slot tops to the pivot are the same for all the slot lengths of a given shaft type. As expected the carbon fiber shafts have the lowest weight with the 32" model weighing only 4.0 oz (113.4 g) and the 34" model weighing 4.2 oz (119.07 g). The 18" aluminum shaft weights 5.9 oz (167.26 g) and the 24" aluminum shaft weighs 7.6 oz (215.46 g).

From the charts (FIGS. 5-10) it is evident that the percentage increase in force for a given added weight at a given shaft position is greater the shorter the shaft and the lighter the head. This is due to the fact that the added weight operates by changing the moment of inertia of the system and has its greatest effect when the original moment of inertia is smallest (i.e., the lightest head and the lightest shaft). The greater the distance between the pivot and the weight, the greater the effect on the change in force. According to Formula 3 the velocity of the ball is directly proportional to the average force so that as the force increases, the velocity of the ball increases. Because of the pendulum effect discussed above lowering the weight position without altering the take-back distance allows one to achieve the same ball velocity as would normally require a greater take-back distance. This reduction in take-back distance results in less push and pull. Thus, by reducing take-back the present system is particularly useful for long putts which normally require so much pull back that pull or push results. Of course, the reduction in take-back can result in an improvement in short putts as well.

The greatest increase in percentage force change over an unweighted shaft is observed with the 32" (81.28 cm) carbon fiber shaft with a 150 g head which shows a 16% increase in force with a 4 oz (113.4 g) weight in the lowest position. According to the United States Golf Association a well maintained green can show an optimal green speed ranging from 8-11 ft (2.4-3.4 m) which is a 37% variation. If one assumes a direct relationship between green speed and force, one can conclude that this club can be tuned to encompass almost half of the speed variation of the green without altering take-back distance because the speed of the club head varies linearly with the force imparted.

Figure 11:
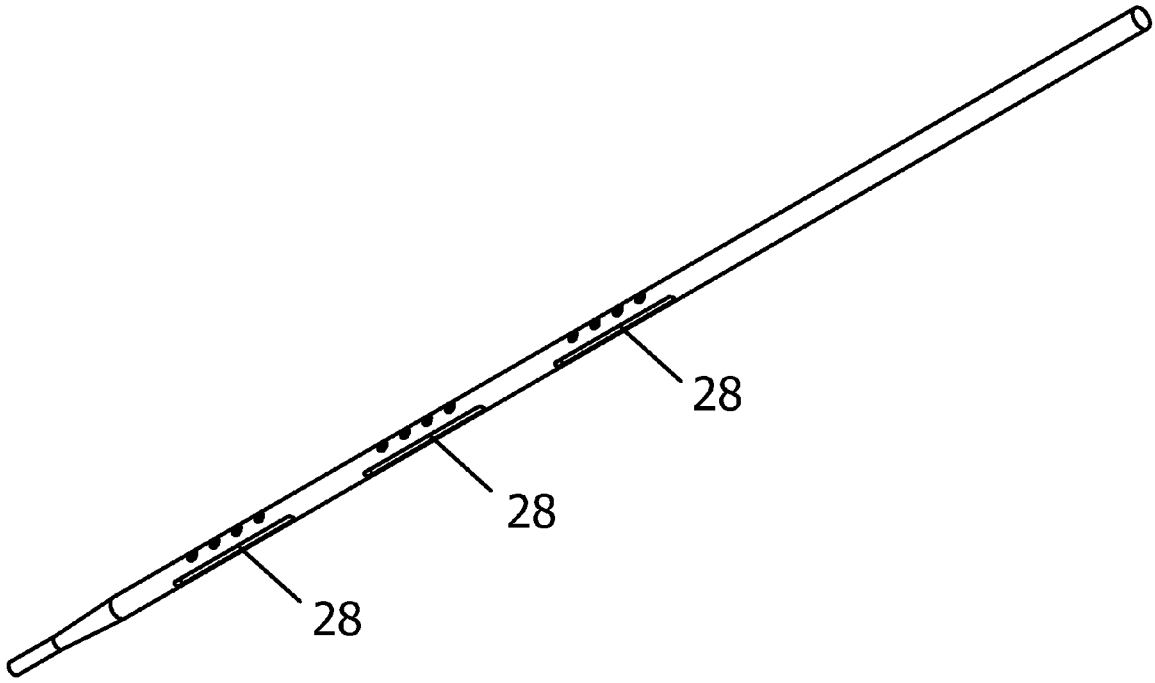
FIG. 11 is a perspective view of a split rail shaft that has three separate openings.
Figure 12:
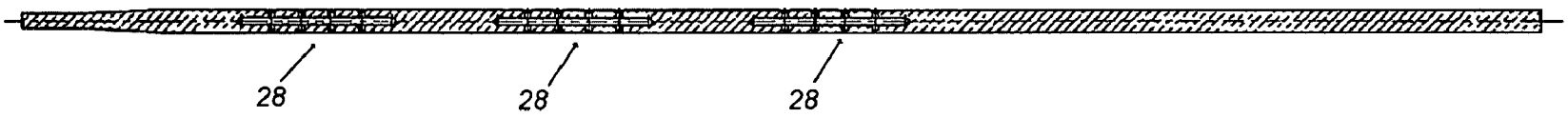
FIG. 12 is a cross-sectional view of a split rail shaft that has three separate openings.

It can also be seen that there is considerable overlap in force change so that a given ball speed can be achieved with more than one setting (i.e., a smaller weight in a lower position has the same effect as a smaller weight in a higher position). This confirms the empirical observation that an even greater range of weights is unnecessary and that there is no need for a system that allows the weight position to be continuously varied. In producing the charts, the position of the weights was simplified by using an upper (top of the slot), lower (bottom of the slot) and middle position. With this version there is considerable overlap in the results. Therefore, the device, as well as its use, can be considerably simplified. Rather than producing a single long slot 22 as shown in FIGS. 1-4, it is actually simpler to manufacture a club with three slot openings 28 (upper, middle and lower). As shown in FIGS. 11 and 12, the slot openings 28 are sized to accept the various sized weights 18. It is useful to have only a small number (here four) of screw holes 24, 20 for each opening, thereby greatly simplifying manufacturing. It is possible to manufacture clubs with different total "slot lengths" according to how far the upper and lower slot openings are spaced apart. For example, an 18" "slot" club is made with the lower edge of the lower slot opening 18" from the upper edge of the upper slot opening. The other slot size clubs have their upper and lower slot openings spaced apart according to the desired total "slot" size. In the molded driver shaft shown in FIGS. 11 and 12 the three slot openings 28 are each 3.75" (9.53 cm) in length. The distance between them is varied according to the desired club shaft length. In the example the upper "grip" region 28 of the shaft is 15.75" (40.01 cm) and the distance from the lower end of the lowest opening to the distal end (where the head will be attached) is 5.5" (13.97 cm).

The presently preferred method of using this simplified three slot openings design is thus quite straightforward. Golfers tend to have a "comfort zone" for a particular club. Each player feels more comfortable with a particular type of club for a particular type of golf shot. Similarly, there is a putting distance that a given golfer will feel most comfortable with. This may be five feet, ten feet, fifteen feet (for putts) or some other distance. This will be the distance that most closely matches the player's ability to control a given club in a repeatable manner. Profession or highly skilled golfers will naturally have a wider comfort zone and be able to control putts over a greater range of distances.

A comfort zone is defined according to the ability of a golfer more closely matching the level or degree of difficulty of the shot at hand. The closer the match, the higher the level of comfort felt by the golfer. When the golfer operates in a comfort zone, the shots made are more accurate. As explained above the current invention reduces the take-back distance resulting in more accurate and longer putting distances. Inherently this increases the comfort zone. Adjusting the weights, both amount and position along the shaft, allows a golfer to increase or decrease putter head speed in a controllable manner. Putter head speed can be increased without increasing take-back distance, thereby keeping the likelihood of push or pull at a minimum.

The method of using the inventive club is simple and involves the concept of "green speed" which is the speed and distance a ball travels on a given green. The general version of this measurement is "surface speed characteristics" which is the speed for any particular portion of a golf course. Physical laws dictate that the faster a ball is traveling when it enters a green, the farther it will travel on that green. However, some greens are "faster" than others meaning that a particular green offers less friction to a traveling ball than another green so that the ball decelerates more slowly and travels farther. A smooth and dry green that has been mowed short will be faster—offer less friction—than a bumpy and moist green that has been mowed to have longer grass. A simple device known as a Stimpmeter is used to accelerate a ball to a uniform and known speed before it rolls on to a green. The distance that the ball travels is then an expression of the green speed. For example, if the ball travels 14 ft (4.27 m), the green speed is 14 which is considered to be quite fast. If the ball rolls on 6 ft (1.83 m), the green speed is 6 which is relatively slow.

Using the formulae presented above and some testing, it is possible to derive a relationship between a given club swung with a given force at a fixed take-back distance and green speed achieved. It turns out that a considerable range of green speeds can be achieved by adjusting the weight positions. Table 3 shows a portion of such a relationship chart for an experimental club. The table shows the position that a given weight should be placed for a given green speed. Comparing the positions with the green speed one sees that for a "fast" green of 14 feet the smallest weight is placed in the least effective position—this is because for a fast green one wants the lowest increase in force. For a slow green of 6 ft speed a larger weight is placed in the most effective (the lowest) position. This gives a compensating boost to ball without significantly changing the take-back distance.

To utilize the present invention the player should first practice putts with the club without weights until the player can reliably produce putts of a repeatable distance and a consistent take-back distance. That is, the player learns to apply a repeatable acceleration at a fixed take-back distance. Next faced with an actual putt the player determines the green speed of the hole in question (the green speed is measured and available a high level professional level course—alternately the player could use a Stimpmeter to measure actual green speed). The following the chart for the particular model of inventive club at hand, the player adjusts the weights to most closely match the known surface speed characteristics. The club then takes care of the required change in head speed without a significant change in take-back distance. It will be appreciated that without the inventive system, a player is faced with the daunting task of changing take-back distance and/or applied force in an attempt to overcome variations in green speed. A very skilled golfer may be equipped to simultaneously adjust these multiple factors to achieve the desired result, but this is beyond the ability of many ordinary golfers. With the inventive device the number of variables is reduced. All the player need do is learn to perform a stroke with a consistent force and a consistent take-back difference. By adjusting the weight system in the club to match the target green speed, the simple consistent stroke is transformed to match the actual green speed of the green at hand.

TABLE 3

Green Speed versus Weight and Weight Position.

| Green Speed | Position along shaft | Weight (oz) |
|---|---|---|
| 14 | Upper | 0.5 |
| 13 | Upper | 1.0 |
| 12 | Upper | 1.5 |
| 11 | Middle | 0.5 |
| 10 | Middle | 1.0 |
| 9 | Middle | 1.5 |
| 8 | Lower | 0.5 |
| 7 | Lower | 1.0 |
| 6 | Lower | 1.5 |

It will be appreciated that such a chart depends not only on the characteristics of the club and the precise take-back difference but the force/acceleration applied by the user. A goal of the present system is for the user to develop a consistent stroke (same take-back distance and same application of force/acceleration). This can be attained by repeated practice putts on a uniform green. The end result will be the ability to reliably produce a putt that goes a set distance (say six feet). Thereafter the weight management system (in conjunction with the appropriate chart for a given club) is used to attain that distance regardless of green speed and using the same consistent stroke. Without the weight management system a player must try to constantly adjust their stroke to account for changes in green speed. This has the tendency of rendering the player's stroke less and less consistent. With sufficient native ability and practice a player may eventually master the process of adjusting the stroke in accord with the green. The present approach accelerates the learning process by allowing the player to develop a consistent stroke while at the same time being able to respond to changes in green speed.

Surprisingly, in actual practice the weight system is effective over a larger range of green speeds than might otherwise be expected. The charts presented as figures suggest approximately a maximum change in force of about 16%. Speed and force are directly proportional (Formula 3) so one would expect the system to handle approximately a 16% change in speed. However, the changes in green speed in Table 3 are in the range of 7% or more for each step (change in speed of one foot). The answer is that ball speed and green speed are not the same thing. Green speed is a measurement of how far a ball traveling at a set initial velocity will travel on a particular green. In altering the ball speed so that the ball will go the same distance on greens of different speeds the magnitude of change in ball speed is not the same as the magnitude of change in green speed. That is, if a green speed is 10 ft and at a given initial velocity a ball travels 5 ft, and then that same initial velocity is applied to a green with a speed of 9 ft, the ball does not travel precisely one foot less—that is 4 ft.

This same principle can be applied to other clubs like drivers where club velocity and ball speed are related to the distance a ball will travel (generally through the air) although ball velocity when it strikes the ground will interact with local surface speed characteristics to control how far the ball will roll. With a driver desired distance is generally the key factor that dictates adjustment of moment of inertia. The overall method is the same but the adjustment tables generally relate desired distance to weight position. With a putter as the green speed decreases moment of inertia is increased to keep the stroke and take-back distance consistent. With a drive using a given club distance can be increased while maintaining a consistent stroke by increasing the moment of inertia.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A golf club including an inline weight management system comprising:

a head adapted to impact a golf ball when the club is swung;

a grip portion for grasping the golf club for swinging the club; and a shaft portion connecting the head and the grip portion, the shaft portion further including a weight management system comprising: one or more weights, at least one longitudinally oriented slot having a width greater than a thickness and sized to allow insertion of one or more weights into said slot to place the weights entirely within the slot, inline with the shaft, at a plurality of different positions along the length of the shaft portion; and means for fixing the weights within the slot.

2. The golf club according to claim 1, wherein the weight management system is formed integrally with the shaft portion.

3. A golf club shaft including an inline weight management system comprising:

an attachment point for a head adapted to impact a golf ball;

a weight management system comprising: one or more weights, at least one longitudinally oriented slot having a width greater than a thickness and in said shaft sized to allow insertion of one or more weights into said slot to place the weights entirely within the slot, inline with said shaft, at a plurality of different positions along the length of said shaft; and means for fixing the weights within the slot.

4. The golf club shaft according to claim 3, wherein the weight management system is formed integrally with the golf club shaft.

* * * * *